US005551260A

United States Patent [19]

Frullini et al.

[11] Patent Number: 5,551,260

[45] Date of Patent: Sep. 3, 1996

[54] METHOD FOR JOINING TWO EDGES OF A KNITTED TUBULAR ARTICLE UPON COMPLETION THEREOF

[75] Inventors: Alberto Frullini; Paolo Frullini, both of Firenze, Italy

[73] Assignee: Fabritex, S.R.L., Firenze, Italy

[21] Appl. No.: 547,276

[22] Filed: Oct. 24, 1995

Related U.S. Application Data

[63] Continuation-in-part of Ser. No. 281,454, Jul. 27, 1994.

[30] Foreign Application Priority Data

Jul. 29, 1993 [IT] Italy ..... FI93A0150

[51] Int. Cl.[6] ..... D04B 9/40

[52] U.S. Cl. ..... 66/148; 66/58

[58] Field of Search ..... 66/8, 13, 48, 58, 66/148

[56] References Cited

U.S. PATENT DOCUMENTS

| | | | |
|---|---|---|---|
| 472,874 | 4/1892 | Griswald | 66/148 |
| 1,308,828 | 7/1919 | Williams | 66/58 |
| 1,364,088 | 1/1921 | Fenn | 66/13 |
| 1,388,227 | 8/1921 | Williams | 66/148 X |
| 2,089,147 | 8/1937 | Lawson et al. | 66/58 X |
| 2,495,585 | 1/1950 | Kuechnel | 66/148 |
| 2,948,240 | 8/1960 | Burd et al. | 66/148 X |

*Primary Examiner*—John J. Calvert
*Attorney, Agent, or Firm*—McGlew and Tuttle, P.C.

[57] ABSTRACT

An initial step of terminating the knitting of the sock on the side of the toe which is left open and performing the following operating steps: moving away the plate; lifting the knitting needles, with the sinkers being closed; further lifting the needles, with the sinkers being open, until the stitches are located above the nib of the sinkers; picking up the stitches and retaining them; lowering the needles; transferring the sock out of the knitting head of the machine, at a predetermined distance therefrom; turning the sock inside out; transferring the stitches of a first semirank or partial knit course (x) onto the corresponding stitches of the second semirank or partial knit course (y); disposing the stitches of the first and second partial knit course (x,y) along an arc of circumference at constant angular distance, with a pitch preset according to the desired hook-up fineness; linking the thus disposed pairs of stitches and making one or more closing knots; cutting the linking thread; moving the sock with the thus linked toe back in its right side out condition and unloading it.

7 Claims, 15 Drawing Sheets

Fig. 10
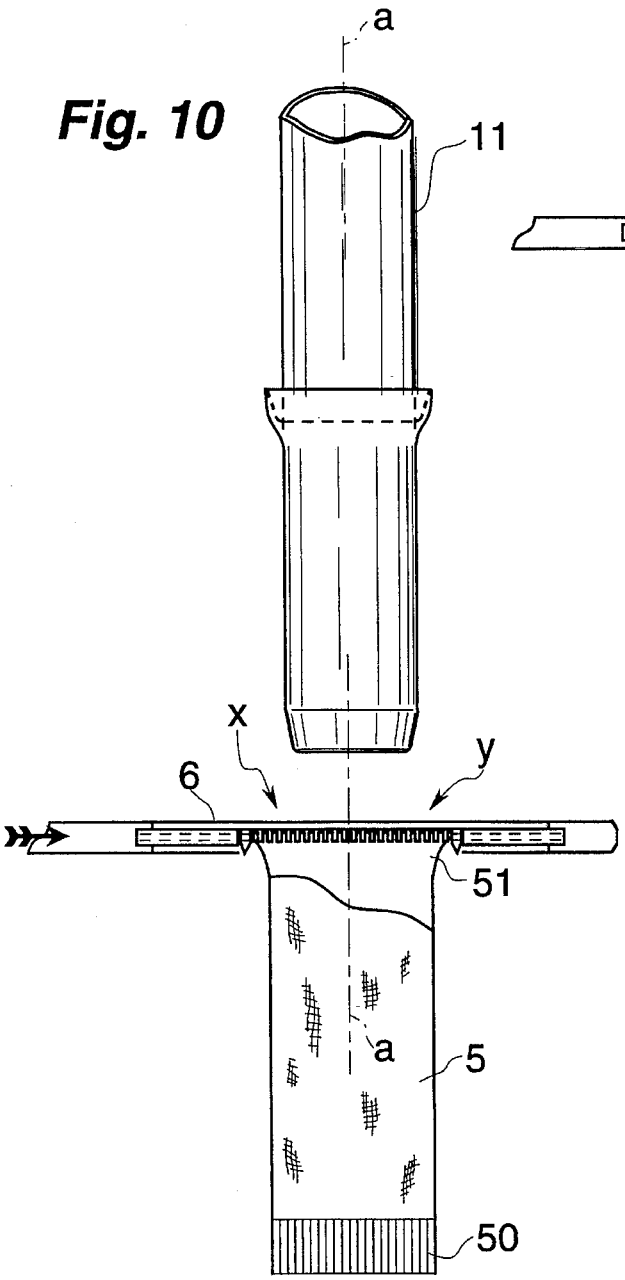
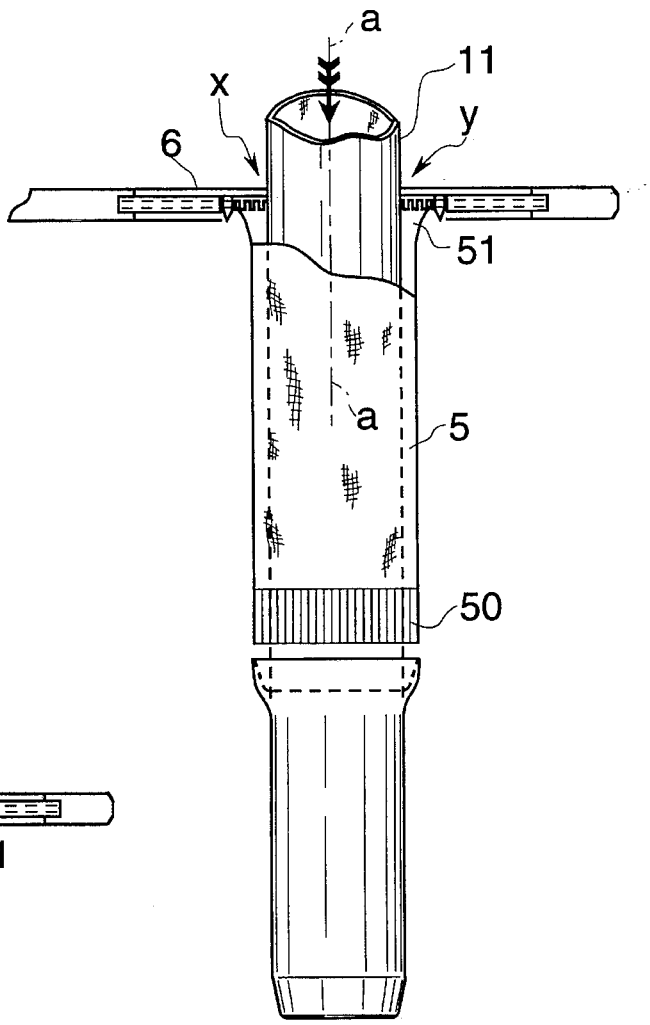
Fig. 11

METHOD FOR JOINING TWO EDGES OF A KNITTED TUBULAR ARTICLE UPON COMPLETION THEREOF

This is a continuation-in-part application of application Ser. No. 08/281,454 filed on Jul. 27, 1994.

FIELD OF THE INVENTION

The present invention refers to a method for operating the union of two edges of a knitted tubular article, such as the linking, that is the formation of the hook-up of the stockings toe, upon completion of the article knitting.

BACKGROUND OF THE INVENTION

Known from documentation IT No. FI93A128 published by the Italian Patent Office and corresponding to U.S. patent application Ser. No. 08/273,023 filed on Jul. 8, 1994 (hereby incorporated by reference). This document describes a method for joining the two edges of a knitted tubular article such as a sock, comprising the initial step of manufacturing the article by beginning from the elastic hem and finishing on the side of the toe which is left open, by means of a circular machine, which method includes the following additional operating steps: —disposing the last-to-form stitches of a first semirank (the term rank being used herein to refer to a knit course or stitch course, and the term semirank being used herein to refer to half of a knit course or a partial knit course) onto the knitting needles of a second semirank of the stitches through a 180° overturning thereof about a diametral axis of the needles cylinder, so that the pairs of stitches of the first and second semiranks will result in retained position on the needles of the second semirank; —lowering the needles of the second semirank, with the sinkers being open, so as to move the stitches of the first and second semiranks to a level beneath that of the sinkers; —lifting the needles of the second semirank, with the sinkers being closed, so that the corresponding pairs of stitches of the first and second semiranks will result retained by the sinkers in a predetermined position relative to the stem of the respective needles; —lifting farther the needles of the second semirank, with the sinkers being open, until all the corresponding pairs of stitches will reach the operating level of the transfer means of the first semirank, so as to have the stitches retained by the transfer means; —lowering the needles of the second semirank so as to have the article released from the knitting needles and the stitches of the first and second semiranks picked up by the transfer means; —disposing the article, with the thus removed stitches, at a predetermined distance from the knitting cylinder; —disposing the thus transferred stitches so as to have them angularly equidistant, with a circular pitch being preset according to the required degree of hook-up fineness; —linking the corresponding pairs of stitches thus disposed to form a chain and, upon completion of the linking operation, making one or more knob for closing the chain; —cutting the linking thread; —releasing the thus joined pairs of stitches of the first and second semiranks to allow the article to be removed in its final, right side our condition.

It may be useful to point out that a stitch is intended in its retained position when it is fitted on a latch needle and at a level between the needle beard hook and the free end of the latch, the latter being in its fully open condition.

The operating method indicated above implies carrying out the above mentioned linking operation with the sock in its right side out condition. This requires special care and accuracy in the execution of the hook-up as this is made on the outer side of the article toe. Moreover, it is necessary to insert the terminal length of the linking thread inside the article after the execution of the chain closing knots to prevent it from being visible on the finished product.

SUMMARY AND OBJECT OF THE INVENTION

The main object of the present invention is to overcome the above mentioned drawbacks and provide an operating method which makes it simpler to close the toe of a knitted tubular article, especially of sock type, while enabling the obtainment of a finished product of good quality.

This result has been achieved, according to the invention, by adopting a method comprising the initial step of manufacturing a knitted tubular article of sock type by starting from the elastic hem and finishing on the side of the toe which is left open, by means of a circular machine, which method includes the following additional operating steps:

—moving the plate away from the knitting head of the machine;

—lifting the knitting needles, with the sinkers being closed, so that the stitches of the last-to-knit rank, that is, the one of the sock toe, will be retained by the sinkers in a position corresponding to the region of removal of the respective needles;

—lifting farther the needles, with the sinkers being open, so as to dispose the stitches of the last rank above the sinkers nib;

—removing individually the stitches from the relevant needles and retaining them;

—lowering the knitting needles so as to clear the sock toe out of the knitting head of the machine;

—transferring the sock, with the stitches of the last rank thus retained, out of the knitting head of the machine, at a predetermined distance therefrom;

—turning the sock inside out, so as to have it, in its everted condition, with the elastic hem thereof being disposed at a suitable distance from the toe;

—transferring the stitches of a first semirank onto the corresponding stitches of the second semirank, through a 180°-overturning thereof about a diametral axis of the circumference delimited by the last-to-knit rank of stitches, so that each stitch of the first semirank will result juxtaposed and coaxial to the corresponding stitch of the second semirank: the term "semirank" referring to a plurality of stitches adjacent and belonging to one edge of the article toe;

—disposing the thus associated stitches of the first and second semiranks along an arc of circumference, at constant angular distance whose pitch is chosen in relation to the desired hook-up fineness;

—hooking-up the thus disposed pairs of stitches and, upon completion of the hook-up operation, making one or more knots for the closing thereof;

—cutting the linking thread;

—moving the article, with the toe thus linked, back to its right-side out, that is, final condition, and unloading it.

According to the present: invention a circular knitting machine is used for making a knitted tubular article, such as a sock by starting from the elastic hem and finishing on the side of the toe which is left open. After the forming of a sock, the plate of the machine is moved away from the knitting head thereof. After this step, a crown supported by a movable arm is positioned above the knitting head. A predetermined number of spikes and relevant opening/closing pegs are housed in corresponding slob of the crown and are used for the transferring of the stitches, which form the last knit course, from the knitting needles of the circular machine to the crown. After the transferring operation, the crown is moved from the knitting station to an everting step, half of the stitches of the last knit course (last rank) are overturned by 180°, in such a manner to obtain a plurality of stitches superimposed in pairs to be linked.

The advantages deriving from the present invention lie essentially in that it is possible to automatically make the hook-up, without breaking off the production of the knitting machine and with the sock being disposed in everted condition, so as to carry out the linking operation for the formation of the hook-up inside the article, and avoiding having to handle the terminal length of the hook-up thread after the cutting thereof. The hook-up may be carried out with any suitable degree of fineness, so as to achieve a finished product of optimum quality.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein:

FIG. 10 is a schematic view showing the sock with the not yet linked toe at the end of its moving away from the knitting machine;

FIG. 11 shows the sock of FIG. 10 upon its predisposition for the turning inside out thereof;

DETAILED DESCRIPTION OF THE PREFERRED EMBODIMENT

Figure 1:
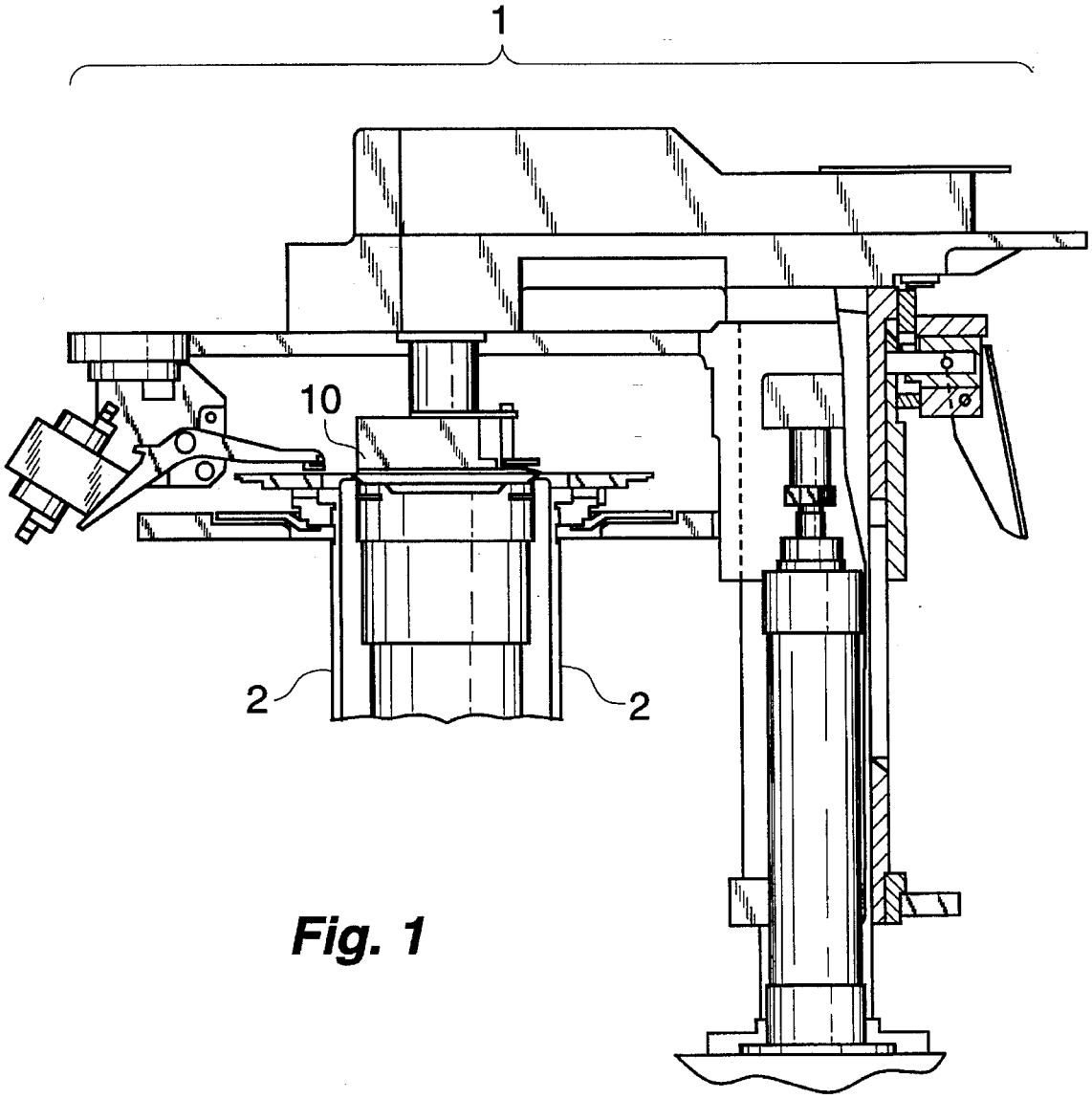
FIG. 1 shows schematically a circular machine to carry out the method according to the invention, upon the formation of a sock.
Figure 2:
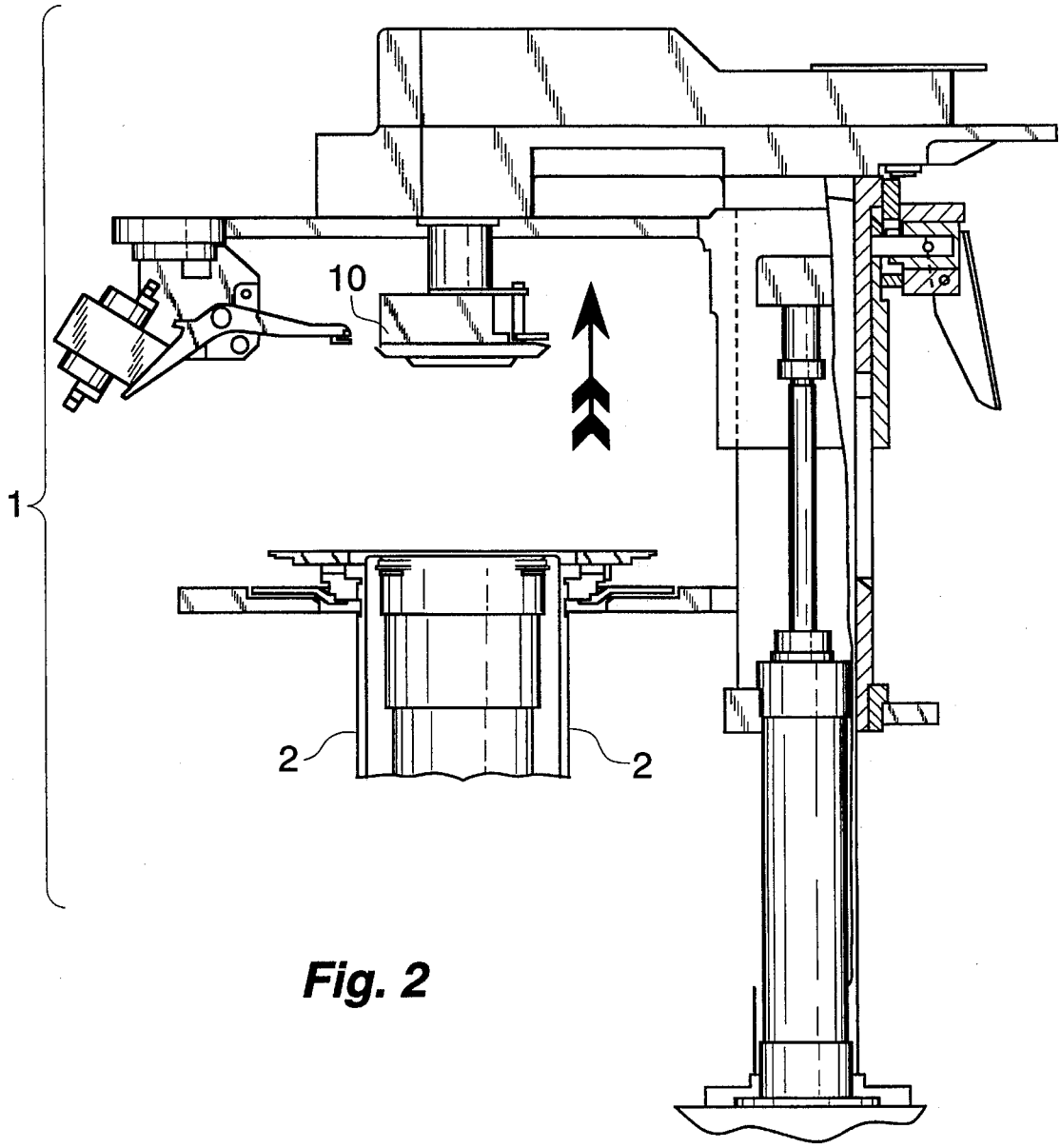
FIG. 2 shows the machine of FIG. 1 when the sock is completed, with the plate being lifted up.
Figure 3:
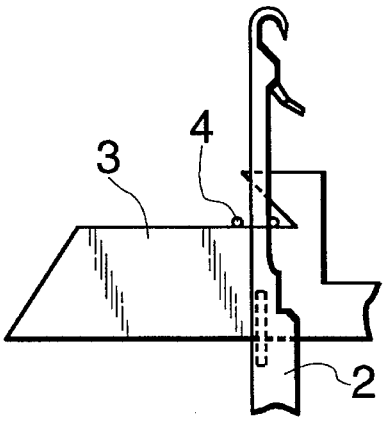
FIG. 3 shows in detail a needle of the knitting cylinder and the corresponding stitch of the last-to-knit rank, with the respective sinker being closed.
Figure 4:
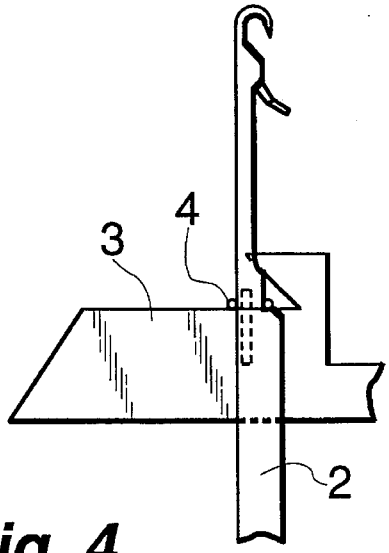
FIG. 4 shows the needle of FIG. 3 upon the lifting thereof with the respective stitch in correspondence of the region where it is removed, and with the relevant sinker being closed.
Figure 5:
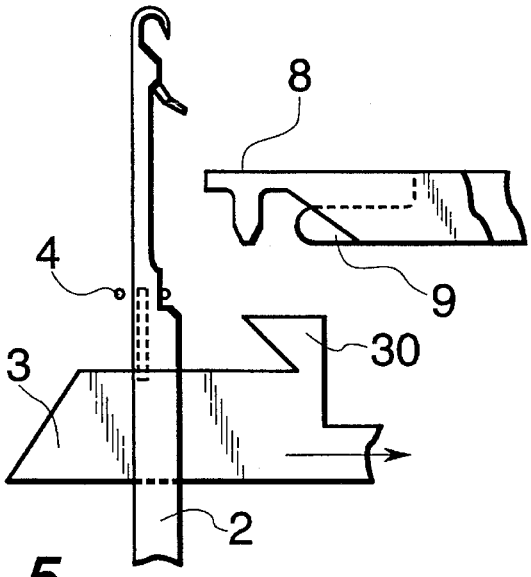
FIG. 5 shows the needle of FIG. 4 upon the lifting thereof to a further extent, with the relevant sinker being open and with the respective stitch being disposed above the sinker nib.
Figure 6:
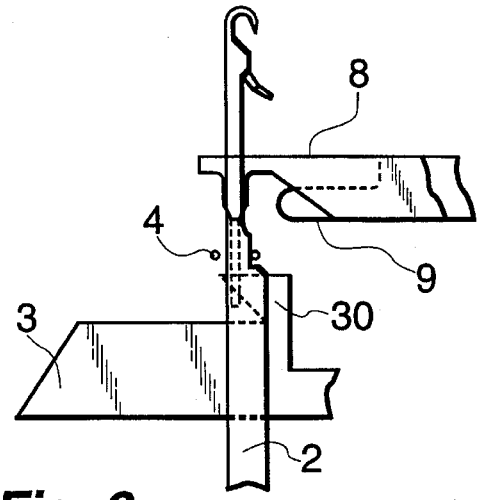
FIG. 6 shows the needle and the stitch of FIG. 5 upon the predisposition thereof for the removal of the stitch.
Figure 7:
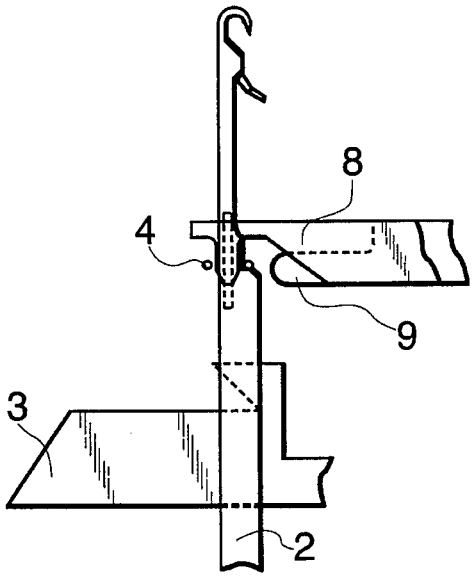
FIG. 7 shows the needle of FIG. 6 at the end of the lifting thereof to allow the removal of the respective stitch.
Figure 8:
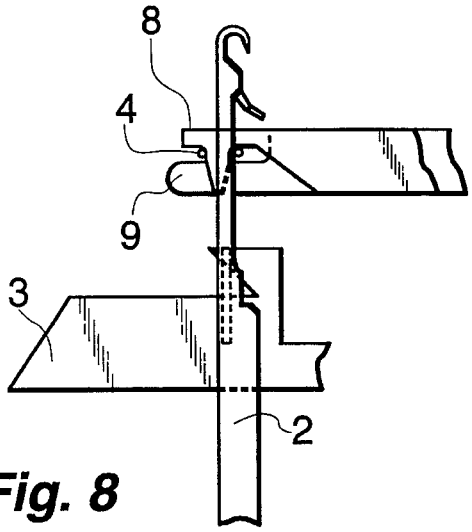
FIG. 8 shows the needle of FIG. 7 upon the lowering thereof for leaving the respective stitch.
Figure 9:
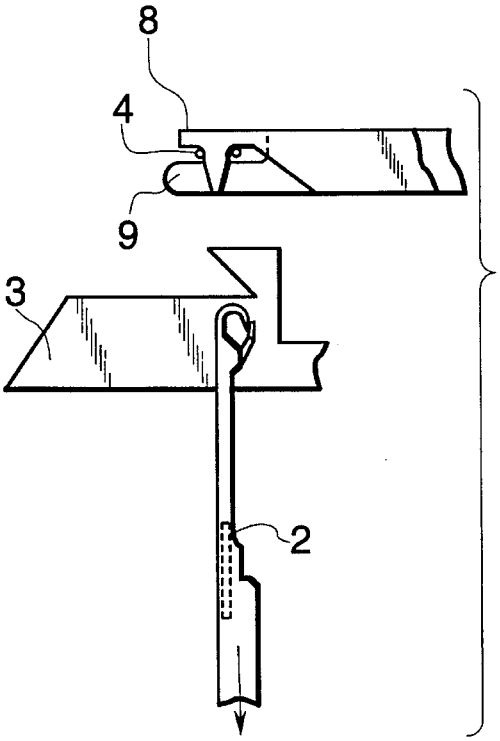
FIG. 9 shows the needle of FIG. 8 in its fully lowered position, with the corresponding stitch fully clear of the hitting members.
Figure 13:
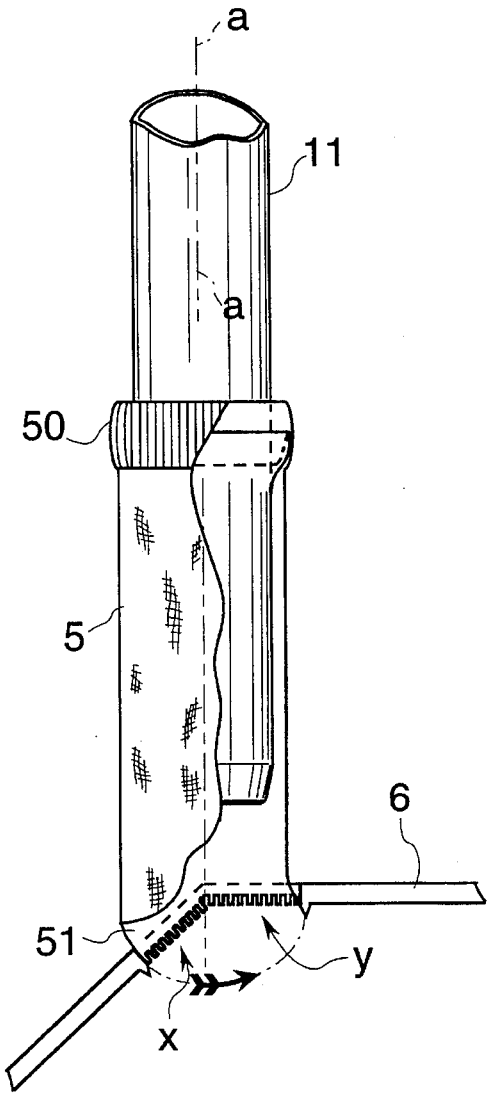
FIG. 13 shows the sock of FIG. 12 upon the step of overturning the stitches of the first semirank of the toe.
Figure 12:
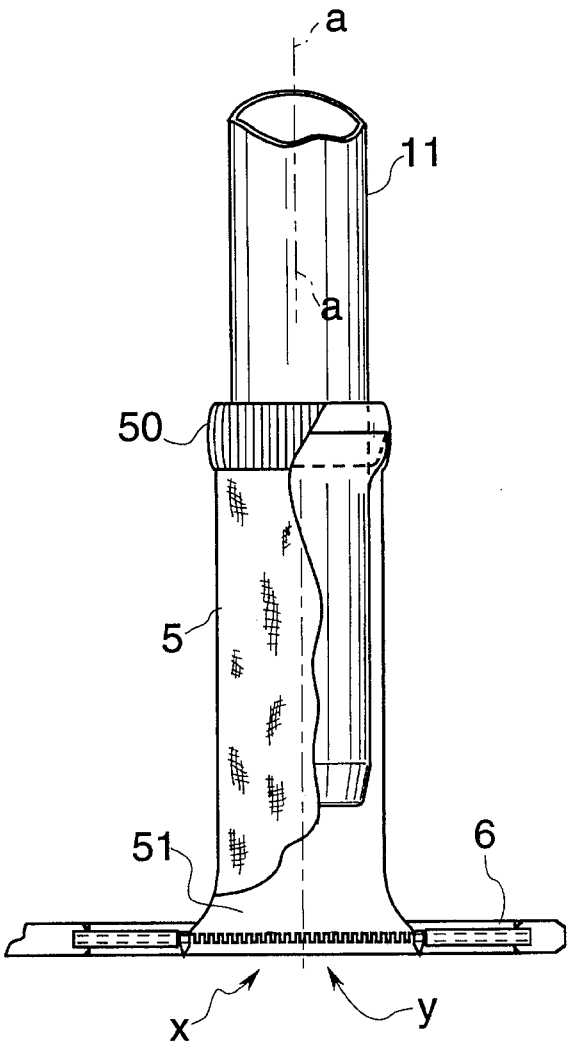
FIG. 12 shows the sock of FIG. 11 in its turned inside out condition.
Figure 14:
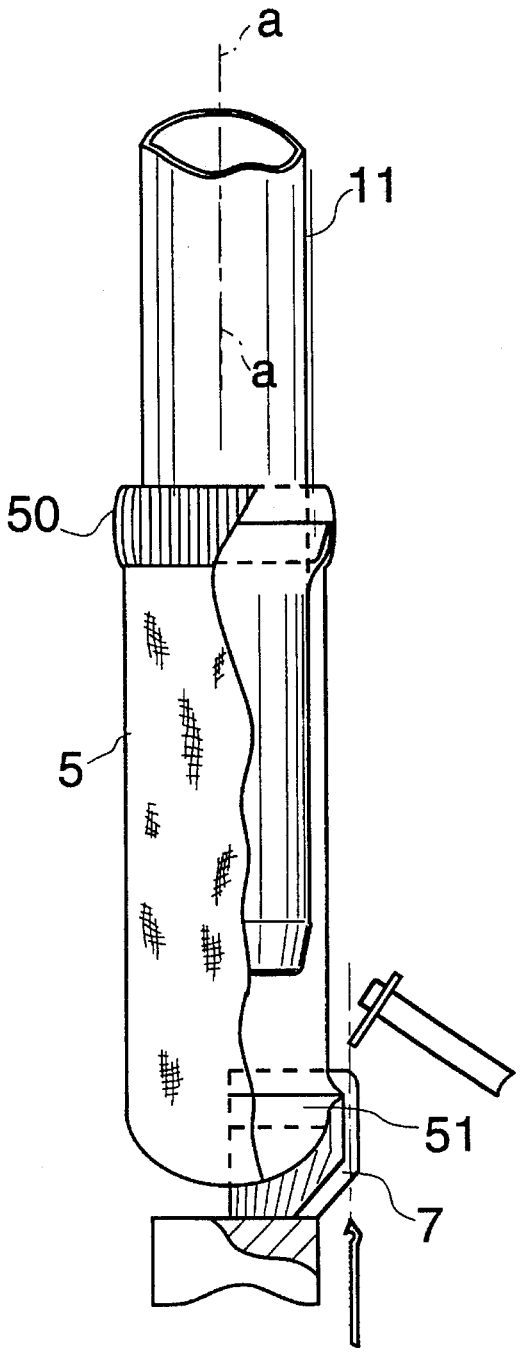
FIG. 14 shows the sock of FIG. 13 upon the liking of its toe.
Figure 15:
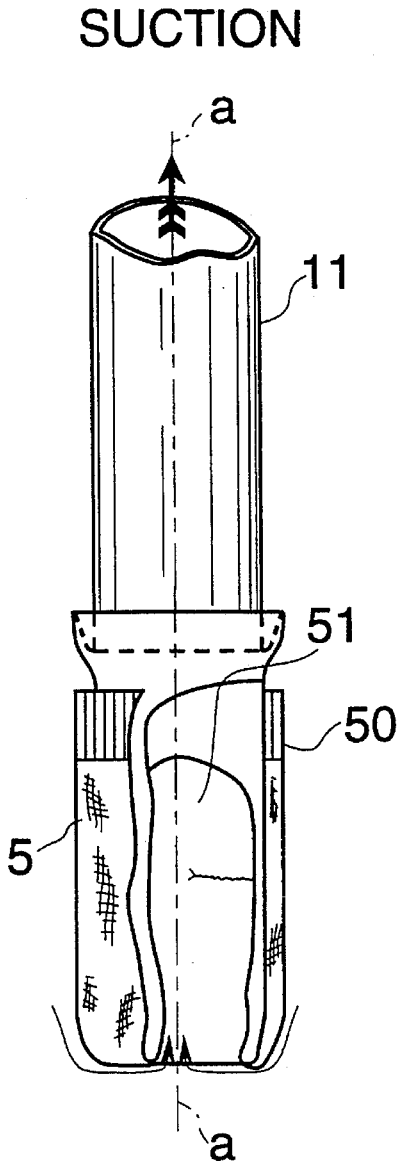
FIG. 15 shows the sock with linked toe upon the turning right-side out thereof and the unloading thereof in right side out condition.
Figure 16A:
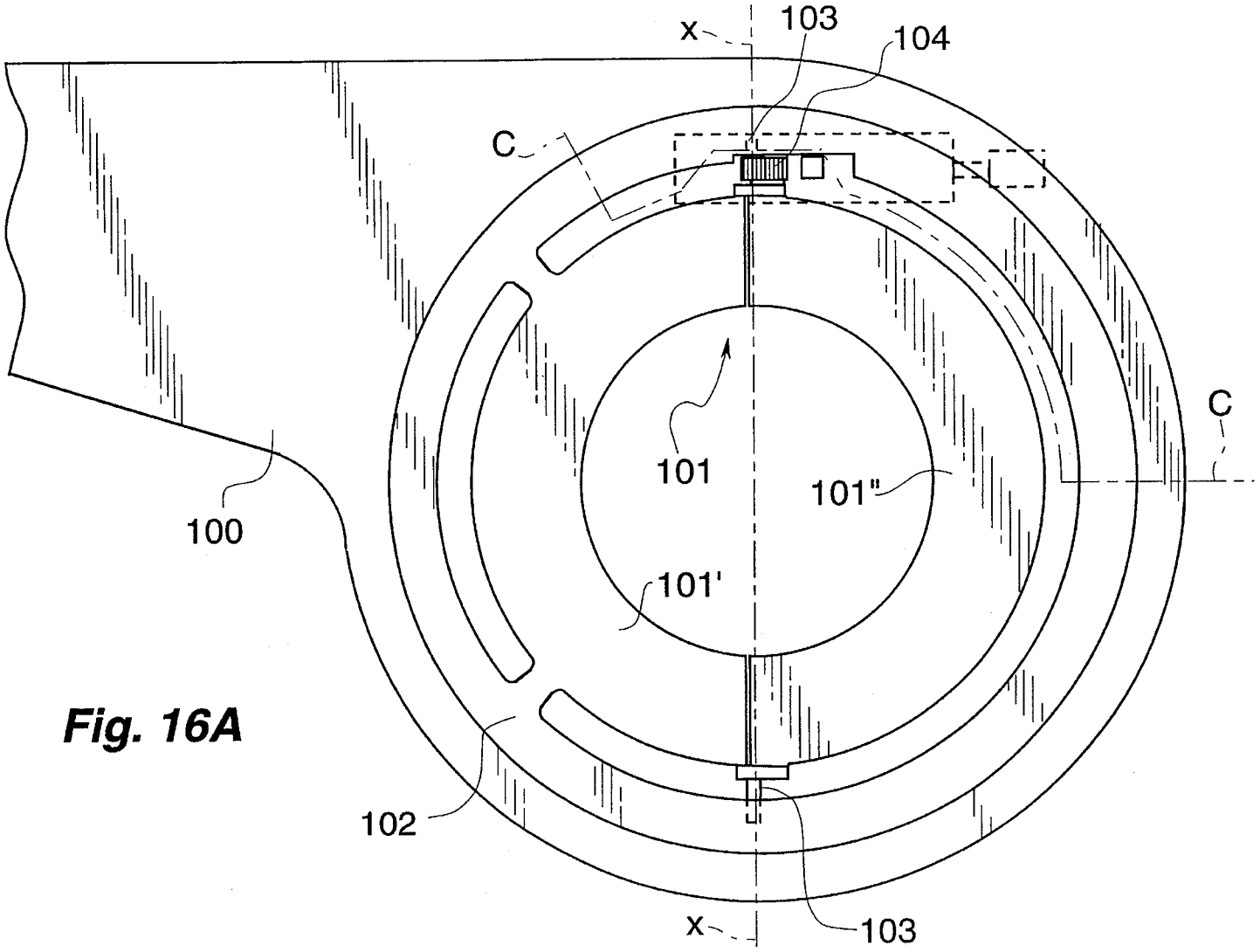
FIG. 16A shows a plan view of the transfer means which performs the transferring of the sock from the knitting machine to the everter/linking station.
Figure 16B:
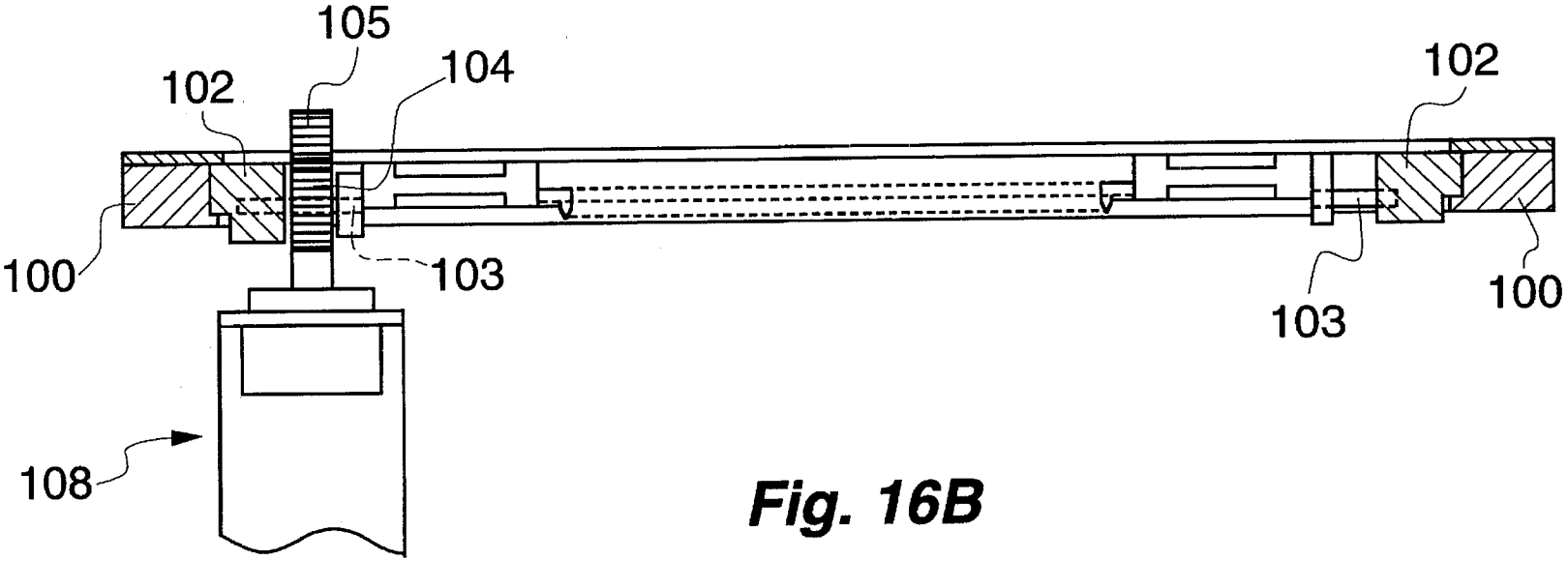
FIG. 16B shows a sectional view along line 16B—16B of FIG. 16A.
Figure 16C:
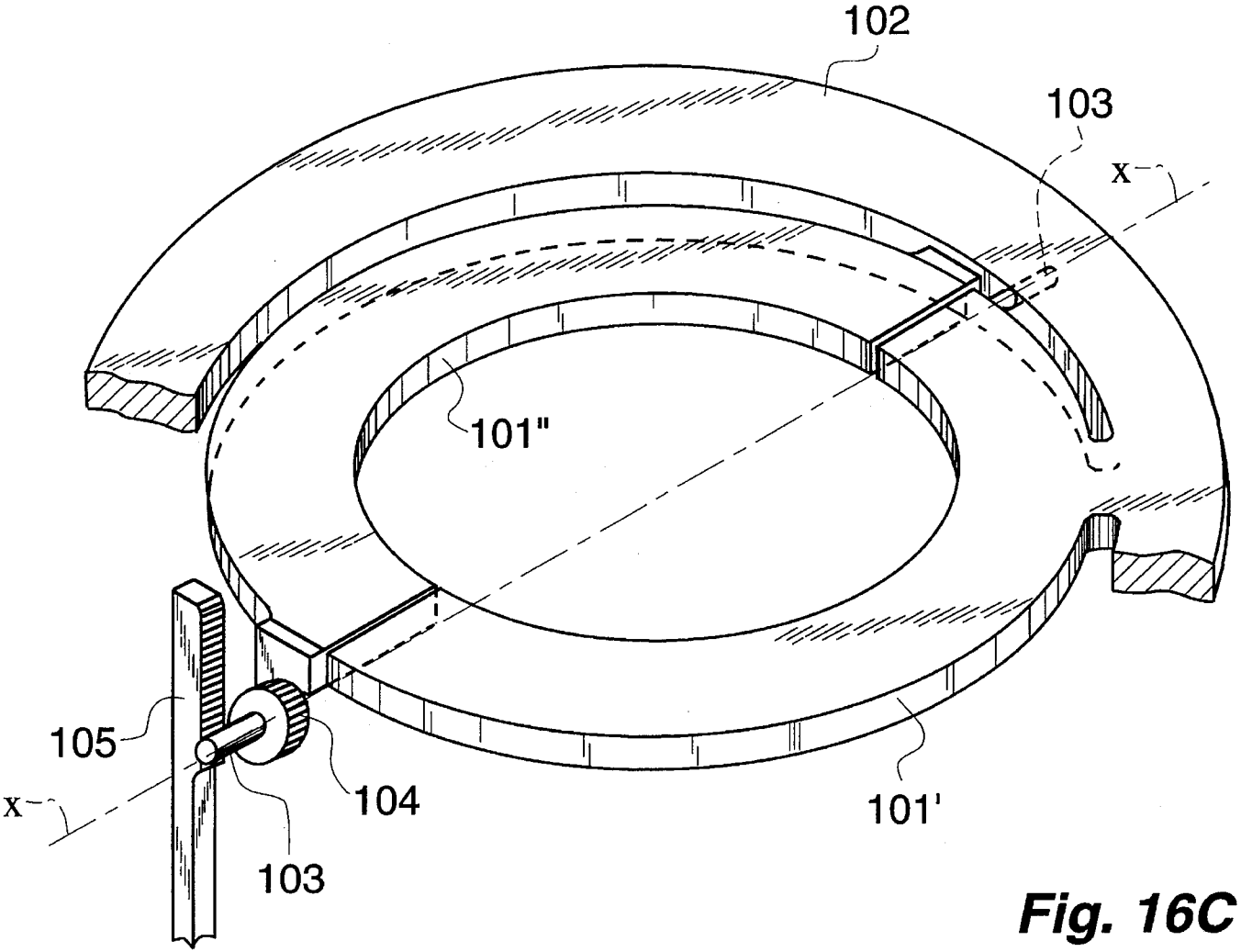
FIG. 16C shows a perspective view of a particular of the means shown in FIG. 16A.
Figure 16D:
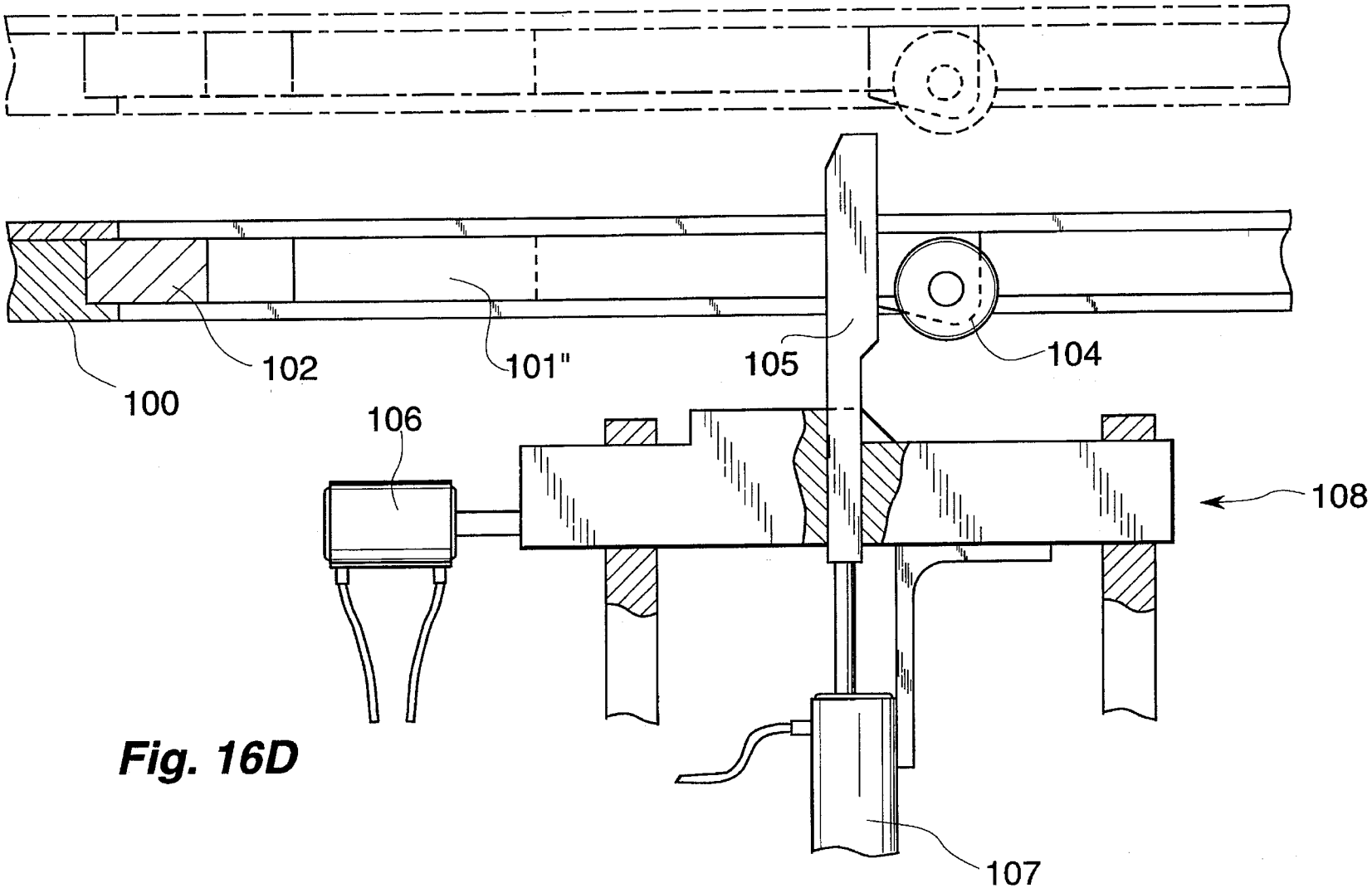
FIG. 16D shows a sectional view along line 16D—16D of FIG. 16A.

Reduced to its basic structure, reference being made to the figures of the attached drawings, the method for carrying out the linking of the toe of a sock, according to the invention, includes the initial step of making a knitted tubular article such as a sock 5 by starting from the elastic hem 50 and finishing on the side of the toe 51 which is left open, by means of a circular machine 1. The following additional operating steps are included:

—moving the plate 10 away from the knitting head of the machine 1 (FIG. 2);

—lifting the knitting needles 2, with the sinkers 3 being closed, so that the stitches 4 of the last-to-knit rank, that is, the ones of the toe end of the sock 5, will be retained by the sinkers in a position corresponding to the region where the respective needles 2 are removed from the stitches (FIGS. 3 and 4);

—lifting farther the needles 2, with the sinkers being open, so as to dispose the stitches 4 above the nib 30 of the sinkers 3 (FIG. 5);

—removing individually the stitches 4 from the relevant needles 2 and retaining them (FIGS. 6–8);

—lowering the needles 2 so as to release the toe 51 of the sock 5 from the knitting head of the machine 1 (FIG. 9);

—transferring the sock 5, with the thus retained stitches 4 of the toe 51 out of the knitting head of the machine 1, to an everting station at a predetermined distance therefrom (FIG. 10);

—turning the sock 5 inside out, so as to have it, in its everted condition, with the elastic hem 50 thereof disposed above the toe 51 (FIGS. 11 and 12);

—transferring the stitches 4 of a first semirank (x) onto the corresponding stitches 4 of the second semirank (y), through a 180°-overturning thereof about a diametral axis of the circumference delimited by the last knitted rank of stitches, so that each stitch 4 of the first semirank (x) will result juxtaposed and coaxial to the corresponding stitch 4 of the second semirank (y) (FIG. 13);

—disposing the thus associated stitches of the first and second semiranks (x,y) along an arc of circumference, at constant angular distance, whose circular pitch is chosen according to the desired hook-up fineness;

—linking the thus disposed pairs of stitches 4 and, upon completion of the linking operation, making one or more knots for the closing thereof (FIG. 14);

—cutting the linking thread;

—moving the sock 5, with the toe 51 thereof thus linked, back to its right-side out, that is, final condition, and unloading it (FIG. 15).

Advantageously, according to the invention, provision is made for transferring the stitches 4 of the first semirank (x) onto the corresponding stitches 4 of the second semirank (y) upon the disposition of all stitches 4 of the last rank onto corresponding transfer means 6 provided for moving them away from the knitting head of the machine 1 and for the subsequent overturning of the stitches 4 of the first semirank (x).

The transfer means 6 includes a crown 101 supported by a movable arm 100 and is positioned above the knitting head. A predetermined number of spikes 8 and relevant opening/closing pegs 9 are housed in corresponding slots of the crown and are for the transferring of the stitches which form the last knit course from the knitting needles of the circular machine to the crown. After the transferring operation, the crown is moved from the knitting station to an everting station wherein the sock, retained by the spikes 8 of the crown 101, is everted. After the everting step, half of the stitches of the last knit course (last rank) are overturned by substantially 180 degrees in such a manner to obtain a plurality of stitches superimposed in pairs to be linked.

The crown 101 is connected to an arm 100 which is movable for example, either by means of a corresponding motor means or by means of the main motor of the circular machine. It could also be moved, for example, by means of a corresponding pneumatic cylinder or other suitable means, in order to move the crown 101.

The crown 101 is in two parts, one of which 101' is solid to a ring 102 which in turn is housed in an annular seat of the arm 100, the other part 101" of the crown being connected to the ring 102 by means of two coaxial hinges 103 in such a manner to be rotatable about the common axis x—x of the hinges. The movable part 101" of the crown 101 is provided with a pinion 104 which is engagable with a toothed rack 105 to perform the rotation thereof about the axis x—x. The toothed rack 105 is supported by a body 108 which is movable parallel to the arm 100 by means of a corresponding cylinder 106 to perform its engagement with the pinion 104. The body 108 is positioned laterally to the crown 101 but spaced from the arm 100. The toothed rack 105 is also connected to a cylinder 107 in order to allow the moving thereof along a direction orthogonal with respect to the arm 100 and in this way obtain the rotation of the rotatable part 101" of the crown. The crown 101 is provided with a predetermined number of slots, wherein the spikes 8 and relevant pegs 9 are slidingly housed. The spikes 8 and pegs 9 are shown in the drawings FIGS. 5, 6, 7, 8 and 9. The spikes 8 and pegs 9 are provided with heels in order to obtain the moving thereof through cam means not shown for sake of clarity.

When the sock is formed by the circular machine, the crown 101 is positioned above the knitting head of the knitting machine 1 and the stitches of the last knitted course are transferred onto the spikes 8 housed in the slots of the crown 101, according to procedural steps known per se and described in the above-identified applications. The arm 100 is then moved away from the circular machine to reach the everter station. In this condition, the open toe end of the sock is retained by the spikes 8 of the crown 101. Once the sock has been everted, the part 101" of the crown 101 is rotated by means of the toothed rack 105 engaging the pinion 104 of the crown. This is done in such a manner so that each stitch of a half, or first portion, of stitches of the last knitted course is coaxial or adjacent to a corresponding stitch of the other half or second portion of the stitches. The body 108 is moved in order to obtain the engagement of 105 with the pinion 104 and the cylinder 107 is operated.

Figure 17A:
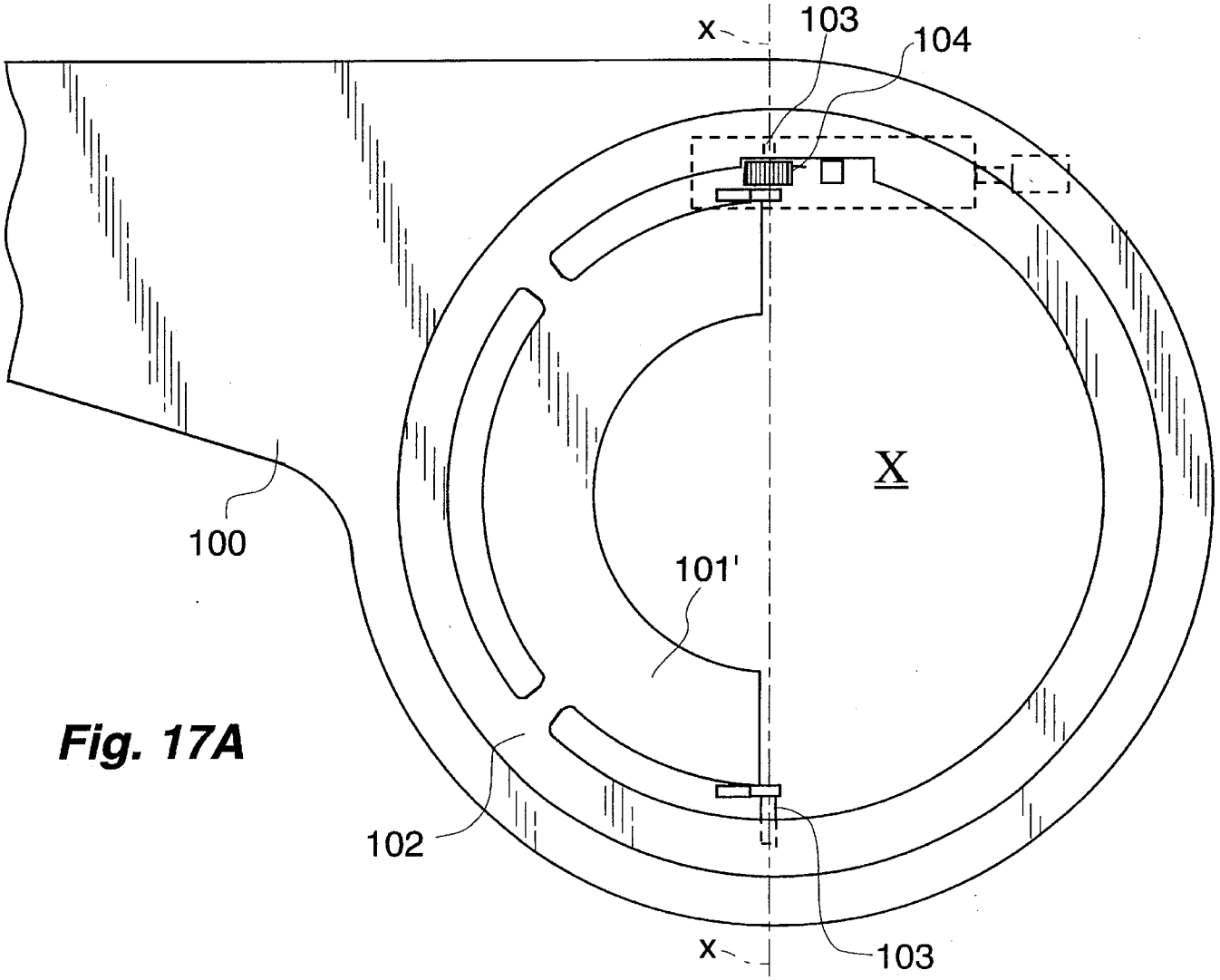
FIG. 17A shows a plan view of the means of FIG. 16A, where the stitches of a half of the last stitches course are overturned.
Figure 17B:
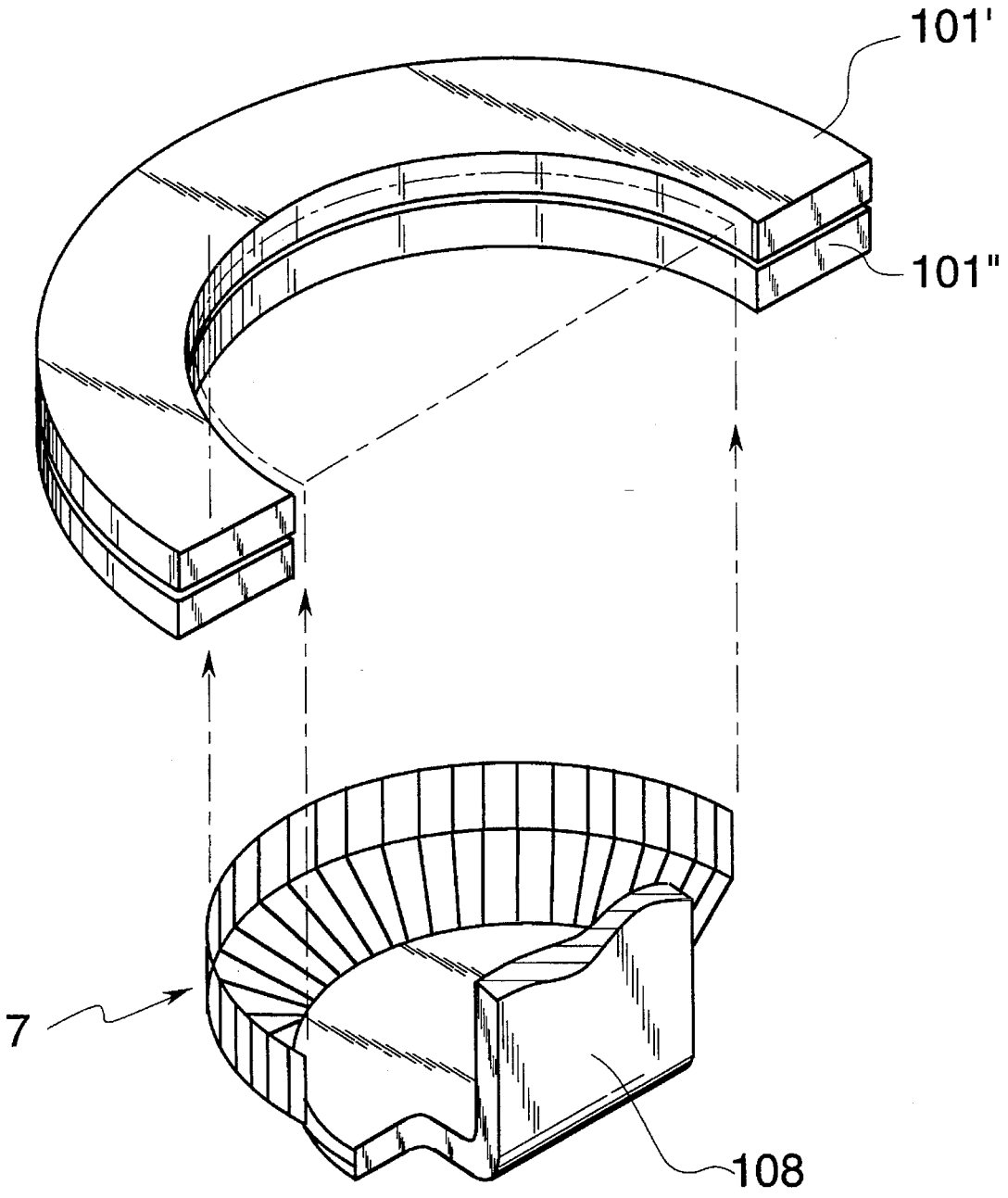
FIG. 17B shows schematically a feature of the means shown in FIG. 17A.
Figure 17C:
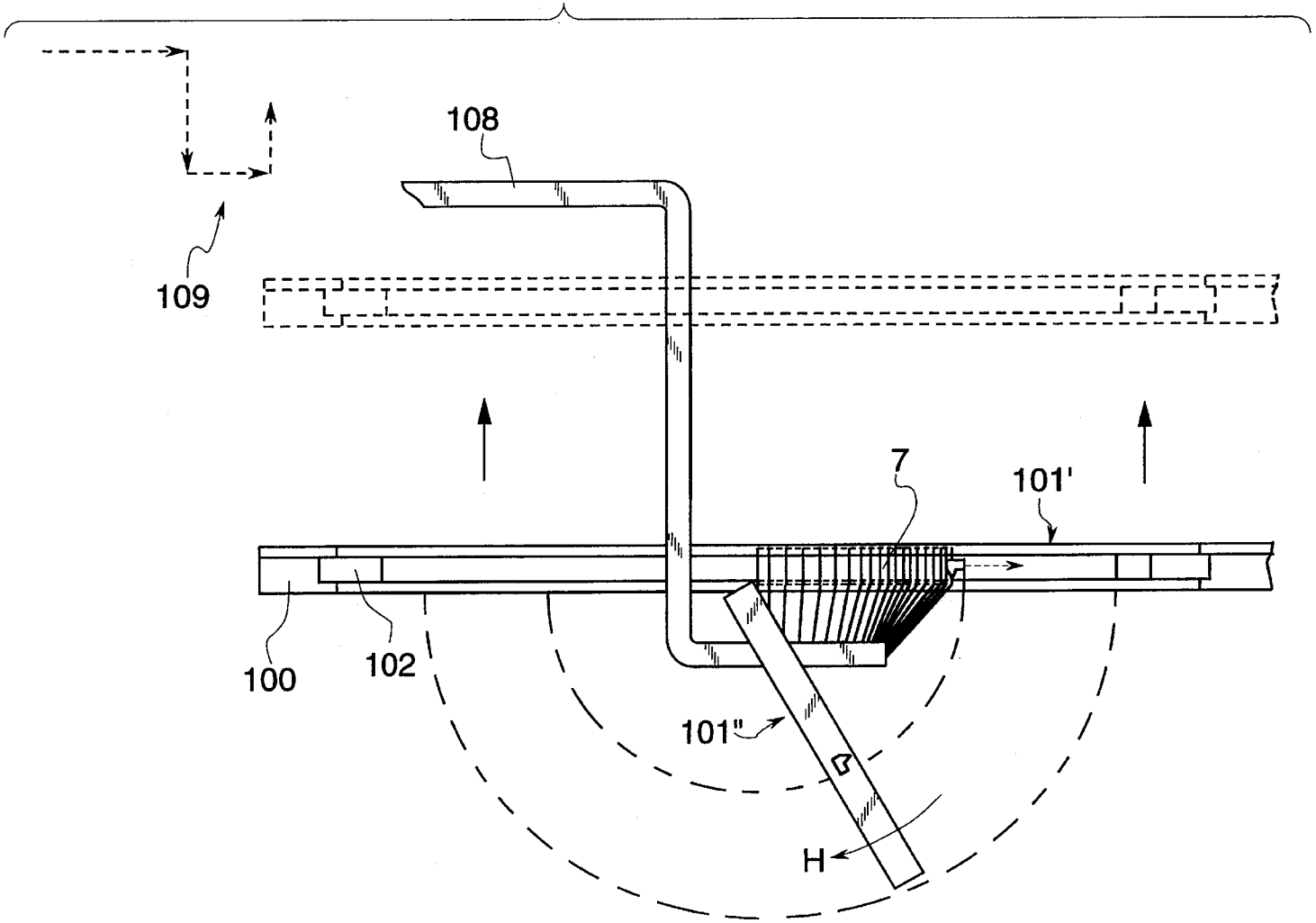
FIG. 17C shows schematically the means of FIG. 17B in an operative condition.
Figure 17D:
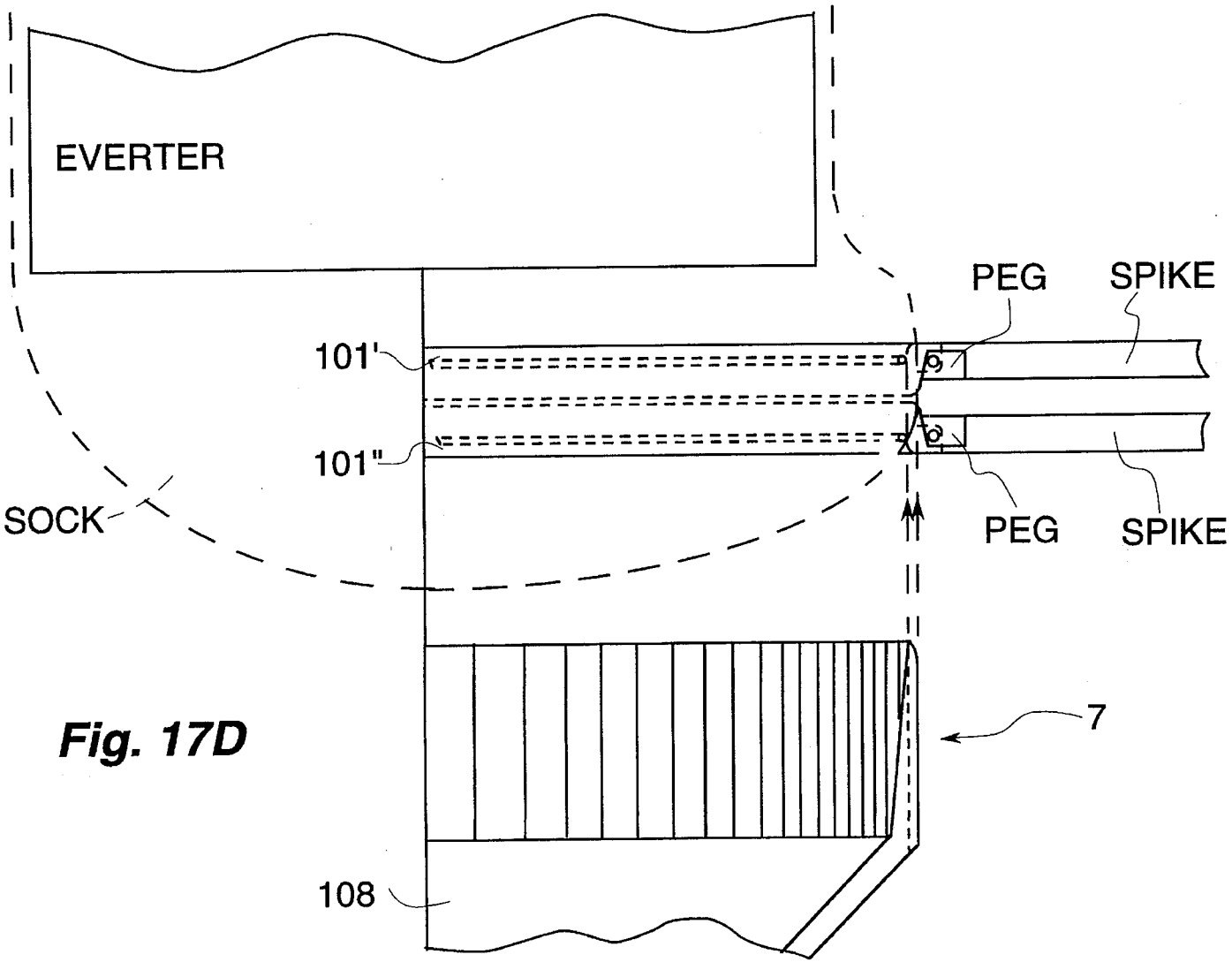
FIG. 17D shows schematically a vertical section of the means shown in FIG. 17B.

At this point, the front of linking spines 7 is positioned under the stitches coaxially disposed. In order to obtain the positioning of the front of spines 7, the support 110 of the linking spines 7 is moved along a suitable path 109. The path 109 of the support 110 substantially has the shape of an inverted "Z". The support 110 is moved towards the arm 100, is lowered to insert the front of spines 7 through the cavity X left free by the rotated part 101" of the crown 101, see FIG. 17A. Then the support 110 is moved forward and lifted in order to insert each spine 7 through the loop of a corresponding pair of stitches. During this operative step, the stitches are retained by the spikes of the crown 100. The inserting of the spines into the loop of the stitches is possible due to the shape and the flexibility of the spikes, pegs and stitches. After the inserting step of the spines 7, the pegs 8 of both parts 101' and 101" are retracted by means of corresponding cams, in order to release the stitches. Also by means of 104 and 105, the part 101" is rotated in the opposite direction with respect to the first rotation, see arrow H of FIG. 17C. The spines 7 are spaced to each other in order to allow the passage of the spikes 8. Afterwards, the crown 101 is lifted by lifting the arm 100 and the stitches are retained in a superimposed position by the spines 7.

Advantageously, in case the number of stitches 4 of the first semirank (x) is different from that of the stitches 4 of the second semirank (y), the stitches 4 which are excluded from the association will be linked all the same.

According to the invention, and with reference to FIGS. 10–15 of the attached drawings, the turning inside out and subsequent turning right-side out of the sock 5 are advantageously operated by a pneumatic everter hose 11 coaxial to the sock 5 and driven into a preset reciprocating motion in the direction of its longitudinal axis (a—a), so as to allow for the introduction thereof within the sock 5 on the side of the toe 51 to hook up, that is engage, the edge of the elastic hem 50, and respectively for the removal thereof to evert the sock 5 with the elastic hem 50 thus engaged. At this stage a linking machine operates the linking of the superimposed stitches.

The same hose 11 is intended to operate the aspiration of the finished sock 5 by acting on the toe 51 thereof, so as to allow the simultaneous turning right-side out and unloading thereof in its final condition (see FIG. 15). The support 110 is then moved away from the arm 100 through the central cavity of the crown 101, and the arm 100 is then positioned in an initial position to start a new cycle. Before starting a new operative cycle, the pegs 9 and the spikes 8 of the crown 101 are disposed in an initial position through corresponding cam means.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. A method for closing an end of a tubular article, the method comprising the steps of:

forming the tubular article on a circular knitting machine;

closing sinkers of the knitting machine to retain stitches of a last course;

lifting knitting needles of the circular machine with the sinkers being closed in order to move the stitches to a position on the needles where the stitches will be removed;

opening the sinkers;

lifting the needles further with the sinkers being open to move the stitches above a nib of the sinkers;

transferring the stitches from the needles to a transfer means;

moving the transfer means with the stitches and the tubular article to an everting station;

everting the tubular article to turn the tubular article inside out;

moving a first portion of the stitches of the everted article adjacent a second portion of the stitches of the everted article by rotating a first portion of the transfer means substantially 180 degrees about a diametrical axis of the tubular article to position the first portion of the transfer means adjacent a second portion of the transfer means;

linking the adjacent first and second portions of stitches of the everted article to close the tubular article;

un-everting the tubular article to turn the tubular article right side out;

unloading the tubular article from the everting station.

2. A method in accordance with claim 1, further comprising:

transferring the first portion of stitches from the first portion of the transfer means to the second portion of the transfer means after said step of moving the first portion of stitches adjacent the second portion of stitches, and before said linking step.

3. A method in accordance with claim 1, further comprising the step of:

transferring the stitches from the transfer means to hook-up spines before said step of linking.

4. A method in accordance with claim 1, further comprising the step of:

aligning stitches of the first portion and stitches of the second portion in a one-to-one correspondence during said moving of the first set of stitches adjacent the second set of stitches;

wherein said linking links all of the stitches of the last course including stitches of the first and second portions unable to align in one-to-one correspondence due to unequal numbers of the stitches in said first and portions of stitches.

5. A method in accordance with claim 1, wherein:

said everting step includes:

providing an everter hose coaxial with the tubular article at the everting station;

moving said everter hose into the tubular article in a longitudinal direction of the tubular article and said everter hose, said moving of said everter hose being though a toe opening of the tubular article defined by the last course of stitches;

engaging a hem end of the tubular article substantially opposite the toe opening with said everter hose;

moving said everter hose out of the tubular article through said toe opening with said hem end still engaged to perform said step of everting.

6. A method in accordance with claim 1, wherein:

said everting of said tubular article causes a hem end of the tubular article to be positioned above the last course of stitches;

the adjacent stitches of the first and second portions of stitches are positioned along an arc of circumference at a substantially constant angular spacing, a circular pitch of the spacing determining hook-up fineness;

said linking uses a linking thread and creates knob in the linking thread for the closing of the tubular article.

7. A method in accordance with claim 5, wherein:

said everter hose is pneumatic.

* * * * *